US011466434B2

(12) United States Patent
Abell et al.

(10) Patent No.: US 11,466,434 B2
(45) Date of Patent: Oct. 11, 2022

(54) HYDRAULIC SYSTEM

(71) Applicant: JC Bamford Excavators Limited, Uttoxeter (GB)

(72) Inventors: Kyle Scott Abell, Uttoxeter (GB); Mark Orton Goodwin, Uttoxeter (GB)

(73) Assignee: JC Bamford Excavators Limited, Uttoxeter (GB)

( * ) Notice: Subject to any disclaimer, the term of this patent is extended or adjusted under 35 U.S.C. 154(b) by 0 days.

(21) Appl. No.: 17/211,786

(22) Filed: Mar. 24, 2021

(65) Prior Publication Data

US 2021/0301499 A1 Sep. 30, 2021

(30) Foreign Application Priority Data

Mar. 24, 2020 (GB) ..... 2004260

(51) Int. Cl.
*E02F 9/22* (2006.01)

(52) U.S. Cl.
CPC ..... *E02F 9/2217* (2013.01); *E02F 9/2285* (2013.01); *E02F 9/2292* (2013.01)

(58) Field of Classification Search
CPC ..... E02F 9/2217; E02F 9/2285; E02F 9/2203; F15B 13/021; F15B 15/31535; F15B 2211/20576
See application file for complete search history.

(56) References Cited

U.S. PATENT DOCUMENTS

2003/0230082 A1* 12/2003 Wook Kim ..... E02F 9/2239 60/429

FOREIGN PATENT DOCUMENTS

| | | | |
|---|---|---|---|
| EP | 2 799 724 | A1 | 11/2014 |
| EP | 2 971 795 | A1 | 1/2016 |
| EP | 2980325 | A1 | 2/2016 |
| EP | 3 015 718 | A1 | 5/2016 |
| EP | 3438468 | A1 | 2/2019 |
| EP | 3556945 | A1 | 10/2019 |
| GB | 2571238 | A | 8/2019 |

(Continued)

OTHER PUBLICATIONS

Search Report for GB 2004260.2, dated Sep. 23, 2020.

(Continued)

*Primary Examiner* — Thomas E Lazo
*Assistant Examiner* — Daniel S Collins
(74) *Attorney, Agent, or Firm* — Marshall, Gerstein & Borun LLP

(57) ABSTRACT

A hydraulic system for a working machine, the hydraulic system includes: a hydraulic fluid reservoir; a boom actuator having an ascending chamber and a descending chamber; a first pump; a first directional control valve comprising a first ascending state configured for moving the boom in the ascending direction, a descending state configured for moving the boom actuator in the descending direction, and a first neutral state; a second pump; a second directional control valve comprising a second ascending state configured for moving the boom actuator in the ascending direction, and a second neutral state; wherein the second directional control valve further comprises a float state configured to connect at least one of the ascending and descending chambers to the hydraulic reservoir for permitting the boom to move freely in the descending and/or descending directions.

19 Claims, 5 Drawing Sheets

(56) References Cited

FOREIGN PATENT DOCUMENTS

| | | | |
|---|---|---|---|
| JP | H10159809 | A | 6/1998 |
| WO | WO-02/055793 | A1 | 7/2002 |

OTHER PUBLICATIONS

Partial European Search Report for European Patent Application No. EP 21163497, dated Oct. 1, 2021.
Extended European Search Repor for EP 21163497.7, dated Feb. 3, 2022.

* cited by examiner

HYDRAULIC SYSTEM

FIELD OF THE INVENTION

The present invention relates to a working machine, a hydraulic system for a working machine, and a method of operating a hydraulic system for a working machine.

BACKGROUND OF THE INVENTION

Various types of working machines are known for soil-shifting operations (e.g. trenching, grading, and loading) and materials handling (e.g. depositing aggregate in trenches, lifting materials and placing them on an elevated platform). Slew excavators are one example of such a working machine, which include a shovel at one end and a working arm arrangement at the other end.

The working arm arrangement is used for manipulating an attachment, such as a bucket, to perform working operations of the types listed above. A prime mover drives a hydraulic pump, in order to provide hydraulic fluid to operate hydraulic actuators to control a function of the working machine, such as raising a boom of the working arm arrangement. Such hydraulic actuators typically have a body defining a bore, a rod extending through the body, and a piston connected to the rod. The piston separates the bore into a "rod side" chamber and a "head side" chamber. Hydraulic fluid is pumped into the "head side" chamber to push the piston so that the rod protrudes to a greater extent from the body. Similarly, hydraulic fluid is pumped into the "rod side" chamber to push the piston so that the rod protrudes to a lesser extent from the body.

Moving the boom of the working arm arrangement in an ascending direction at an acceptable speed requires a higher flow of hydraulic fluid from the hydraulic pump than moving in a descending direction at an acceptable speed. This is because moving in the descending direction requires hydraulic fluid to be pumped into the "rod side" chamber, which has a smaller volume for receiving hydraulic fluid (for a given length of the chamber) than the "head side" chamber, due to the rod taking up a substantial portion of the volume of the "rod side" chamber. In addition, gravity assists with movement of the boom in the descending direction. If a hydraulic fluid flow rate suitable for moving the boom in the ascending direction at an acceptable speed is provided for moving the boom in the descending direction, the boom would descend too quickly (e.g. this could increase the risk of crushing a person or object, or damaging the working arm). If a hydraulic fluid flow rate suitable for moving the boom in the descending direction at an acceptable speed is provided for moving the boom in the ascending direction, the boom would ascend too slowly (e.g. this could would reduce the time efficiency of the working machine functions).

One option for managing the varying requirements of hydraulic fluid for moving the boom in different directions is to operate the hydraulic pump at a reduced capacity when moving in the descending direction, and at maximum or close to maximum capacity when moving in the ascending direction. However, hydraulic pumps operate most efficiently close to their maximum capacity, which means such hydraulic systems would have a reduced efficiency when moving the boom in the descending direction.

The present invention seeks to overcome, or at least mitigate, one or more problems of the prior art.

SUMMARY OF THE INVENTION

According to a first aspect of the invention, a hydraulic system for a working machine of the kind having a chassis and a boom pivotally attached to the chassis is provided, the hydraulic system comprising:

a hydraulic fluid reservoir;

a boom actuator configured to move the boom in an ascending direction and a descending direction, the boom actuator having an ascending chamber and a descending chamber;

a first pump;

a first directional control valve comprising a first ascending state configured to direct hydraulic fluid from the first pump to the ascending chamber to move the boom in the ascending direction, a descending state configured to direct hydraulic fluid from the first pump to the descending chamber to move the boom actuator in the descending direction, and a first neutral state where the first pump is isolated from the ascending chamber and the descending chamber;

a second pump;

a second directional control valve comprising a second ascending state configured to direct hydraulic fluid from the second pump to the ascending chamber to move the boom actuator in the ascending direction, and a second neutral state where the second pump is isolated from the ascending chamber and the descending chamber; and wherein the second directional control valve further comprises a float state configured to connect at least one of the ascending and descending chambers to the hydraulic reservoir for permitting the boom to move freely in the descending and/or descending directions.

Hydraulic pumps are most efficient when operating close to their maximum output. Therefore, having two pumps to provide a flow of hydraulic fluid to move the boom in the ascending direction, but only using one of these pumps to provide a flow of hydraulic fluid to move the boom in the descending direction, is more efficient than using a single large pump which operates at a reduced output level when moving the boom in the descending direction.

Since the second pump is only required to assist the first pump to move the boom in the ascending direction, the second directional control valve only requires an ascending state and a neutral state. However, typical directional control valves for hydraulic systems often have three positions or 'states' (e.g. 3 position spool valves), which results in a state on the second directional control valve which is redundant for the purposes of boom movement. Therefore, providing the float state at this redundant position of the second directional control valve, rather than in a separate independent float valve, reduces the required number of valves to achieve the same functionality. This results in a cheaper and/or more compact system.

By connecting the ascending chamber to the hydraulic fluid reservoir, hydraulic fluid is permitted to flow out of the ascending chamber and into the hydraulic fluid reservoir. In other words, the boom is permitted to move freely in the descending direction. Similarly, by connecting the descending chamber to the hydraulic fluid reservoir, hydraulic fluid is permitted to flow out of the descending chamber and into the hydraulic fluid reservoir. In other words, the boom is permitted to move freely in the ascending.

In exemplary embodiments, the hydraulic system is configured to permit the boom to move freely by setting the first directional control valve to the first neutral state and setting the second directional control valve to the float state.

In exemplary embodiments, the boom actuator comprises a body having a bore, a piston configured for reciprocating movement within the bore and a rod connected to the piston and extending through the body, wherein the piston is configured to separate the bore into a head side chamber and a rod side chamber, and wherein the head side chamber is the ascending chamber and the rod side chamber is the descending chamber.

Providing a head side chamber and a rod side chamber separated by the piston provides a simple means of altering the position of the piston and the rod coupled thereto, via altering the volume of hydraulic fluid in the head and rod side chambers. For example, increasing the volume of hydraulic fluid in the head side chamber whilst decreasing the volume of hydraulic fluid in the rod side chamber causes the rod to extend out of the body of the boom actuator (i.e. this causes the boom to move in the ascending direction). Similarly, increasing the volume of fluid in the rod side chamber whilst decreasing the volume of fluid in the head side chamber causes the rod to retract into the body of the boom actuator (i.e. this causes the boom to move in the descending direction).

In exemplary embodiments, the float state of the second directional control valve is configured to connect the ascending chamber and descending chamber to the hydraulic fluid reservoir.

By connecting both the ascending and descending chambers to the hydraulic fluid reservoir, the boom is permitted to move freely in either direction.

In exemplary embodiments, the hydraulic system further comprises a float valve comprising: a blocked state configured to disconnect one of the ascending and descending chambers from the hydraulic fluid reservoir; and an open state configured to connect said one of the ascending and descending chambers to the hydraulic fluid reservoir.

Having a float valve that is configured to connect or disconnect only one of the chambers to the hydraulic fluid reservoir provides a means of having a "single float" mode, wherein the boom actuator is permitted to move freely in only one direction, which may be advantageous for certain working machine operations. For example, when drilling with a pneumatic drill coupled to an end of the boom, it may be desirable to allow the boom to move downwards with gravity as a drilling surface is broken apart by the pneumatic drill.

In exemplary embodiments, the float state of the second directional control valve is configured to connect one of the ascending or descending chambers to the hydraulic fluid reservoir, and wherein the float valve is configured to connect or disconnect the other of the ascending and descending chambers to the hydraulic fluid reservoir independently of the second directional control valve.

By having the float state of the second directional control valve configured to connect one chamber to the hydraulic fluid reservoir and the float valve configured to connect the other chamber to the hydraulic fluid reservoir independently, the chambers can be put in "float" mode separately or in tandem. In other words, this arrangement allows single float in the ascending chamber (i.e. free movement of the boom in the descending direction), single float in the descending chamber (i.e. free movement of the boom in the ascending direction) or dual float in both chambers (i.e. free movement of the boom in either direction).

In exemplary embodiments, the float state of the second directional control valve is configured to connect the ascending chamber and the descending chamber to the hydraulic fluid reservoir, and wherein the float valve is configured to connect or disconnect one of the ascending or descending chambers to the hydraulic fluid reservoir via the second directional control valve when in the float state.

By having the float state of the second directional control valve connect both chambers to the hydraulic fluid reservoir and a separate float valve configured to connect one of the chambers via the float state of the second directional control valve, the float valve provides a means of switching between dual float mode (where the boom is permitted to move freely in either direction) and single float mode (where the boom is only permitted to move in a single direction).

In exemplary embodiments, the float state of the second directional control valve is configured to connect the ascending chamber to the descending chamber.

By connecting the ascending chamber to the descending chamber, hydraulic fluid is permitted to flow between these chambers. Therefore, when a force is exerted on the boom actuator (e.g. to push a piston separating the two chambers), hydraulic fluid will be pushed out of one chamber and into the other. This allows the boom to move freely in either direction.

Furthermore, by allowing hydraulic fluid to flow between the two chambers in float mode, rather than independently connecting these chambers to tank, the hydraulic fluid in the ascending and/or descending chambers can be maintained at a higher pressure than the hydraulic fluid reservoir. In other words, there is a "regenerative flow" between the chambers. This allows the boom actuator to be controlled more quickly after the second directional control valve transitions out of the float state.

In exemplary embodiments, the float state of the second directional control valve comprises an orifice configured to restrict the flow of hydraulic fluid to the hydraulic fluid reservoir from the ascending chamber and/or the descending chamber.

By restricting the flow of hydraulic fluid to the hydraulic fluid reservoir, the boom moves in the descending and/or ascending direction more slowly. This prevents the boom from lifting or descending too quickly when the second directional control valve is in the float state, which reduces the risk of accidents (e.g. crushing under the boom) or damage to the working machine.

In exemplary embodiments, the hydraulic system further comprises an orifice positioned between the hydraulic fluid reservoir and the second directional control valve, wherein the orifice is configured to restrict the flow of hydraulic fluid to the hydraulic fluid reservoir from the ascending chamber and/or the descending chamber.

By restricting the flow of hydraulic fluid to the hydraulic fluid reservoir, the boom moves in the descending and/or ascending direction more slowly. This prevents the boom from lifting or descending too quickly when the second directional control valve is in the float state, which reduces the risk of accidents (e.g. crushing under the boom) or damage to the working machine.

In exemplary embodiments, the first ascending state of the first directional control valve or the second ascending state of the second directional control valve is further configured to connect the descending chamber to the hydraulic fluid reservoir.

In this way, as hydraulic fluid from the first pump enters the ascending chamber, hydraulic fluid is flushed from the descending chamber to the hydraulic fluid reservoir, which prevents a build-up of pressure in one or both chambers.

In exemplary embodiments, the descending state of the first directional control valve is further configured to connect the ascending chamber to the hydraulic fluid reservoir.

In this way, as hydraulic fluid from the first pump enters the descending chamber, hydraulic fluid is flushed from the ascending chamber to the hydraulic fluid reservoir, which prevents a build-up of pressure in one or both chambers.

In exemplary embodiments, the hydraulic system further comprises a control system configured to change the state of the first and second directional control valves.

Having a control system configured to change the state of the first and second directional control valves provides a means of directing fluid around the hydraulic system in order to move the boom.

In exemplary embodiments, the control system is configured to permit the second directional control valve to transition to the float state when a float selection input of a working vehicle is actuated.

In this way, a user is able to selectively switch to the float state when undertaking a machine operation which requires the boom to operate in a floating mode.

In exemplary embodiments, the control system is configured to detect a state of the boom actuator and to permit the second directional control valve to transition to the float state if one or more entry conditions are satisfied.

By requiring one or more entry conditions to be satisfied, the second directional control valve does not enter float mode when it would be dangerous to do so or risk damaging equipment. For example, if the boom is in the air with a heavy load, it may fall down too quickly in float mode which could result in a person or object being crushed, or damage to the working machine. Similarly, if the boom is descended beyond the bottom of a chassis of a working machine so that the chassis is jacked upwards from the ground, entering float mode could result in the chassis falling quickly to the ground which could result in injury to an operator located on the chassis, or damage to the working machine.

In exemplary embodiments, the control system comprises an ascending pressure sensor configured to detect pressure in the ascending chamber and a descending pressure sensor configured to detect pressure in the descending chamber, wherein the control system is configured to permit the second directional control valve to transition to the float state if a pressure differential between the ascending chamber and the descending chamber is less than a threshold value.

By comparing the relative pressure between the two chambers, it is possible to determine if the boom is in the air (i.e. pressure in the ascending chamber is significantly higher than the descending chamber), or jacking up a chassis of the working machine (i.e. pressure in the descending chamber is significantly higher than the ascending chamber).

In exemplary embodiments, the threshold value is greater than 5 bar.

In exemplary embodiments, the threshold value is 10 bar.

In exemplary embodiments, the control system is configured to provide an alert to a working vehicle if a float selection input is actuated and one or more entry conditions are not satisfied.

By providing such an alert, the user is made aware that they need to adjust the position of the boom until the entry conditions are met (e.g. moving the boom downwards until an implement coupled thereto is resting on the ground).

In exemplary embodiments, the first directional control valve and the second directional control valve are directional spool valves.

Spool valves are a simple means of providing valves with multiple 'states' or positions. Furthermore, spool valves provide an easy means of transitioning between states, via movement of the spool.

In exemplary embodiments, the first directional control valve is spring-biased towards the first neutral state and the second directional control valve is spring-biased towards the second neutral state.

By spring biasing the control valves to the first and second neutral states, the boom actuator does not move unless some sort of input from a user or control system moves them to an alternative state. Advantageously, this also means that in the event of a loss of power, the boom actuator (and therefore a boom connected thereto) does not move. In other words, this provides a fail-safe arrangement.

In exemplary embodiments, the first directional control valve and second directional control valve are pilot-operated valves.

Being pilot-operated provides a simple means of overcoming the spring biasing force to move the first and/or second control valves away from the respective first and second neutral states.

In exemplary embodiments, the first directional control valve comprises a first pressure port configured to receive hydraulic fluid to move the first directional control valve to the first ascending state, and a second pressure port configured to receive hydraulic fluid to move the first directional control valve to the descending state.

In exemplary embodiments, the second directional control valve comprises a third pressure port configured to receive pressurized hydraulic fluid to move the second directional control valve to the second ascending state, and a fourth pressure port configured to receive pressurized hydraulic fluid to move the second directional control valve to the float state.

In exemplary embodiments, the hydraulic system further comprises one or more pilot control valves configured to selectively direct hydraulic fluid to the first, second, third and fourth pressure ports.

Providing pilot control valves provides a means of directing flow from a hydraulic pump to the pressure ports, in order to control the state of the control valves as required.

In exemplary embodiments, the one or more pilot control valves comprise a first pilot control valve comprising a third ascending state configured to direct hydraulic fluid to the first and third pressure ports.

By directing hydraulic fluid to both the first and third ports, both directional control valves are moved to the ascending state, which allows the first pump and second pump to work in tandem to move the boom in the ascending direction.

In exemplary embodiments, the first pilot control valve is manually operated via a joystick or the like.

In exemplary embodiments, the one or more pilot control valves further comprise one or more floating selection valves configured to direct hydraulic fluid to either the second pressure port or the fourth pressure port.

By directing hydraulic fluid to the second or fourth pressure ports, either the first control valve can be moved to the descending state (second pressure port) or the second control valve can be moved to the float state (fourth port). By directing a flow of hydraulic fluid from to only one of the second or fourth ports, the floating selection valve(s) ensure that the boom is only in one of its descending or float modes. In other words, this prevents the boom being simultaneously in float mode and descending mode, which could lead to unpredictable movement of the boom.

In exemplary embodiments, the one or more pilot control valves comprise a first pilot control valve comprising a third ascending state configured to direct hydraulic fluid to the first and third pressure ports, and an alternative function state configured to direct hydraulic fluid to the one or more floating selection valves.

In exemplary embodiments, the hydraulic system further comprises a float valve comprising: a blocked state configured to disconnect one of the ascending and descending chambers from the hydraulic fluid reservoir and an open state configured to connect said one of the ascending and descending chambers to the hydraulic fluid reservoir, wherein the float valve is spring-biased towards the blocked state and further comprises a fifth pressure port configured to receive pressurized hydraulic fluid to move to the open state, and wherein the one or more floating selection valves are further configured to selectively direct hydraulic fluid to the fourth and/or fifth pressure ports, or the second pressure port.

Such a floating selection valve arrangement allows the hydraulic system to operate in either a 'dual float' mode in which the boom can move freely in either direction, a 'single float mode' in which the boom can move freely in a single direction, or a 'descending mode' in which the boom moves in the descending direction. In other words, this prevents the boom being simultaneously in the descending mode and one of the float modes.

In exemplary embodiments, the one or more floating selection valves are solenoid-operated, and wherein the hydraulic system further comprises a control system configured to actuate the one or more floating selection valves.

By having solenoid operated valves actuated via a control system, the state of the first and second directional control valves and/or float valve can be controlled easily via one or more user inputs of a working machine.

In exemplary embodiments, the hydraulic system further comprises a dedicated pilot pump configured to supply hydraulic fluid to the pressure ports.

Hydraulic pumps operate most efficiently when operating close to their maximum output, therefore having a separate pump for the pilot system, rather than having a larger first or second pump with a hydraulic line branching off to the pilot control valves, provides a more efficient hydraulic system.

According to a second aspect of the invention, a working machine is provided, the working machine comprising a hydraulic system according to the first aspect of the invention.

According to a third aspect of the invention, a method of operating the hydraulic system of the first aspect of the invention is provided, the method comprising one or more of the following steps:

i) moving the boom in the ascending direction via setting the first directional control valve to the first ascending state, and setting the second directional control valve to the second ascending state;

ii) maintaining the position of the boom via setting the first directional control valve to the first neutral state, and setting the second directional control valve to the second neutral state;

iii) moving the boom in the descending direction via setting the first directional control valve to the descending state, and setting the second directional control valve to the second neutral state; and/or iv) permitting the boom to move freely via setting the second directional control valve to the float state, and setting the first directional control valve to the first neutral state.

In exemplary embodiments, the hydraulic system further comprises a float valve comprising: a blocked state configured to disconnect one of the ascending and descending chambers from the hydraulic fluid reservoir; and an open state configured to connect said one of the ascending and descending chambers to the hydraulic fluid reservoir; wherein step iii) further comprises optionally, setting the float valve to the open state.

Having a float valve that is configured to connect or disconnect only one of the chambers to the hydraulic fluid reservoir provides a means of having a "single float" mode, wherein the boom actuator is permitted to move freely in only one direction, which may be advantageous for certain working machine operations. For example, when drilling with a pneumatic drill coupled to an end of the boom, it may be desirable to allow the boom to move downwards with gravity as a drilling surface is broken apart by the pneumatic drill.

In exemplary embodiments, step iii) further comprises:

a) actuating a float selection input of the working vehicle;

b) detecting a state of the boom actuator;

c) permitting the second directional control valve to transition to the float state if one or more entry conditions are satisfied by the state of the boom actuator;

d) providing an alert to the working vehicle and/or inhibiting the second directional control valve from transitioning to the float state if the float selection input is actuated and one or more entry conditions are not satisfied.

In this way, a user is able to selectively switch to the float state when undertaking a machine operation which requires the boom to operate in a floating mode. By requiring one or more entry conditions to be satisfied, the second directional control valve does not enter float mode when it would be dangerous to do so or risk damaging equipment. For example, if the boom is in the air with a heavy load, it may fall down too quickly in float mode which could result in a person or object being crushed, or damage to the working machine. Similarly, if the boom is descended beyond the bottom of a chassis of a working machine so that the chassis is jacked upwards from the ground, entering float mode could result in the chassis falling quickly to the ground which could result in injury to an operator located on the chassis, or damage to the working machine.

Furthermore, by providing such an alert, the user is made aware that they need to adjust the position of the boom until the entry conditions are met (e.g. moving the boom downwards until an implement coupled thereto is resting on the ground). Inhibiting the second directional control valve from transitioning to the float state if the entry conditions are not satisfied offers an added safety benefit, since it is not possible to enter float mode unless it is safe to do so (e.g. even if the operator ignores the alert).

In exemplary embodiments, step b) comprises detecting a pressure differential between the ascending chamber and descending chamber, and step c) comprises permitting the second directional control valve to transition to the float state if the pressure differential between the ascending chamber and descending chamber is less than a threshold value.

By comparing the relative pressure between the two chambers, it is possible to determine if the boom is in the air (i.e. pressure in the ascending chamber is significantly higher than the descending chamber), or jacking up a chassis of the working machine (i.e. pressure in the descending chamber is significantly higher than the ascending chamber).

DETAILED DESCRIPTION

Figure 1:
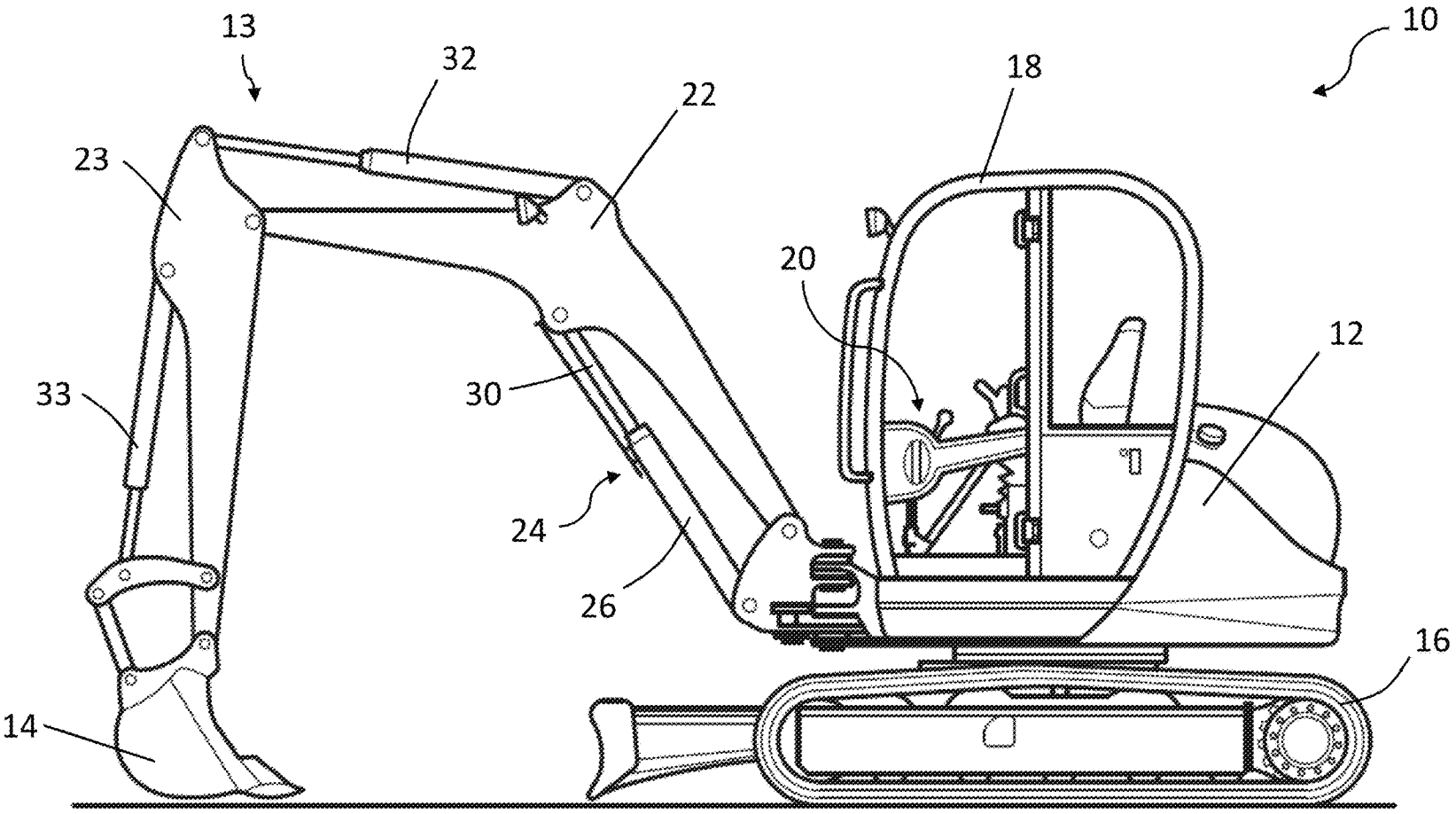
FIG. 1 is a side view of a working machine, according to an embodiment.

Referring to FIG. 1, a working machine according to an embodiment is indicated at 10. The working machine 10 has a chassis 12, a working arm 13 attached to the chassis 12, and an implement 14 connected to a free end of the working arm 13. In the illustrated embodiment, tracks 16 are provided to move the working machine 10. In alternative embodiments, wheels may be provided to move the working machine 10, instead of tracks 16.

The working machine 10 includes a cab 18 with a collection of controls 20 for moving the working arm 13, the tracks 16, or controlling other functions of the working machine 10.

The working arm 13 includes a boom 22 pivotally attached to the chassis 12, a dipper arm 23 pivotally attached to the boom 22, and an implement pivotally attached to the dipper arm 23. In the illustrated embodiment, the implement is a bucket 14, which is used for soil-shifting or materials handling operations (e.g. trenching, grading, and loading) and/or materials handling (e.g. depositing aggregate in trenches, lifting materials and placing them on an elevated platform). In alternative embodiments, the bucket 14 may be removed and replaced with an alternative implement, such as a hydraulic hammer drill. A hydraulic hammer drill includes a drill bit configured for reciprocating movement under the action of pressurized hydraulic fluid (e.g. hydraulic fluid supplied via an auxiliary hose of a hydraulic system of the working vehicle 10). Such a hydraulic hammer drill is typically used for breaking apart materials (e.g. a concrete/tarmac road surface).

A boom actuator 24 is provided to move the boom 22 in an ascending direction and a descending direction. The boom actuator 24 is provided in the form of a boom actuator body 26 defining a bore, a piston 28 (shown in FIGS. 2 to 5) configured for reciprocating movement within the bore, and a rod 30 connected to the piston 28 and extending through the boom actuator body 26. The working machine 10 also includes a dipper actuator 32 similar to the boom actuator 24, for pivoting the dipper arm 23 with respect to the boom 22, and a bucket actuator 33 similar to the boom actuator 24, for pivoting the bucket 14 with respect to the dipper arm 23.

The working machine 10 also includes a hydraulic system for controlling the boom actuator 24, which will be described in more detail in relation to FIGS. 2 to 5. Other portions of the hydraulic system (i.e. portions of the hydraulic system not shown in FIGS. 2 to 5), and/or other hydraulic systems are provided for controlling the dipper actuator 32, bucket actuator 33 and other hydraulic functions of the working vehicle 10.

In the illustrated embodiment, the working machine 10 is a slew excavator. In alternative embodiments, the working machine 10 may be any type of working machine including a boom 22 and boom actuator 24 (e.g. a backhoe loader).

Figure 2:
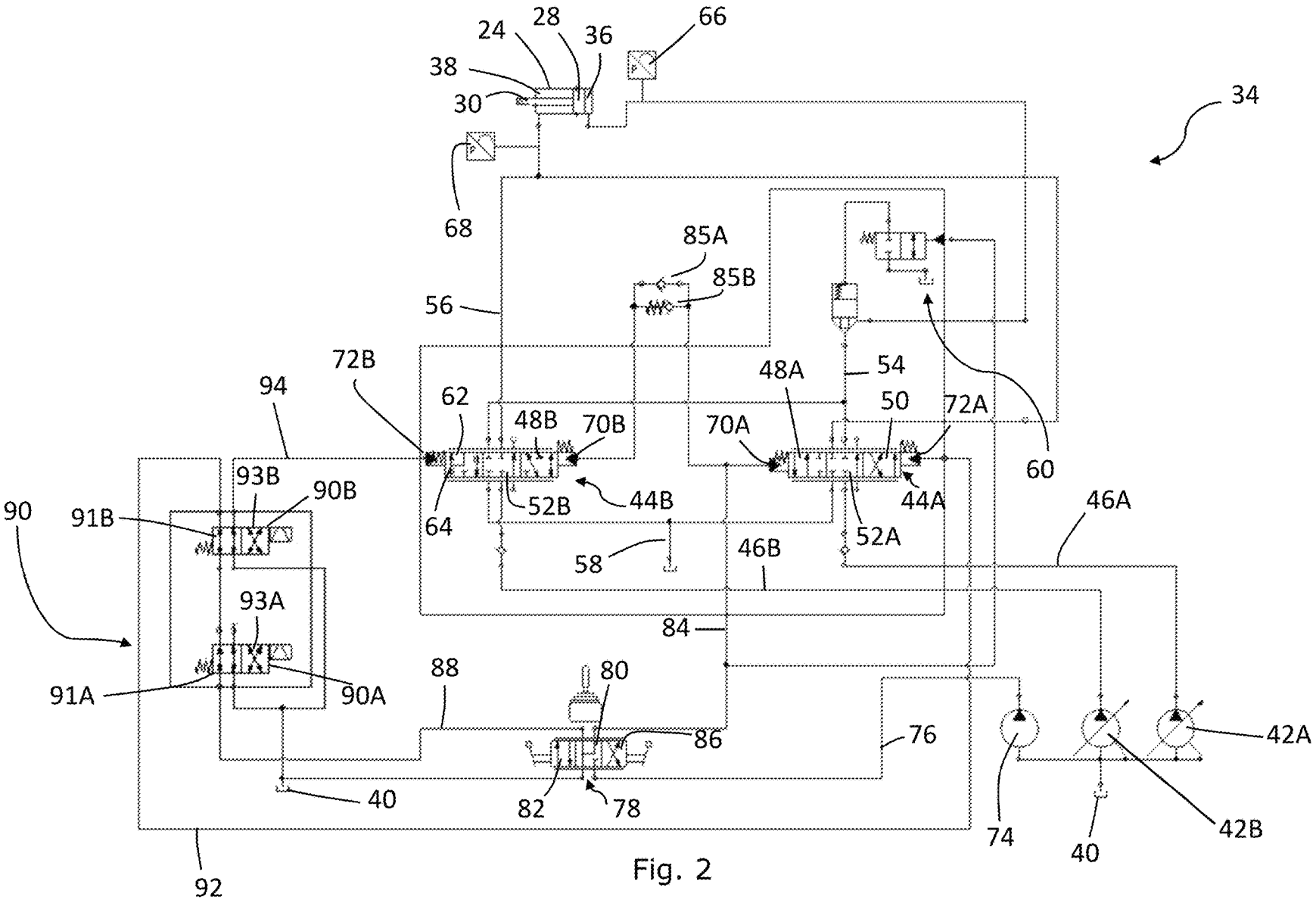
FIG. 2 is a hydraulic system for the working machine of FIG. 1, according to an embodiment.

Referring now to FIG. 2, a hydraulic system for the working machine 10 of FIG. 1 is indicated at 34. The hydraulic system 34 is configured to supply hydraulic fluid to the boom actuator 24 in order to control movement of the boom 22.

As can be seen in this figure, the piston 28 is configured to separate the bore of the boom actuator 24 into an ascending chamber 36 (or "head side" chamber) and a descending chamber 38 (or "rod side" chamber). Movement of the piston 28, and therefore movement of the rod 30 connected thereto, is controlled via altering the volume of hydraulic fluid in the ascending and descending chambers 36, 38.

The hydraulic system 34 for controlling the boom actuator 24 includes the following components: hydraulic fluid reservoir 40, first pump 42A, second pump 42B, first directional control valve 44A, second directional control valve 44B, first feed line 46A, second feed line 46B, ascending line 54, descending line 56 and tank line 58.

The first pump 42A has an inlet side connected to the hydraulic fluid reservoir 40, and an outlet side connected to the first directional control valve 44A via the first feed line 46A. Similarly, the second pump 42B has an inlet side connected to the hydraulic fluid reservoir 40, and an outlet side connected to the second directional control valve 44B via the second feed line 46B. The first and second directional control valves 44A, 44B are connected to the ascending chamber 36 of the boom actuator 24 via the ascending line 54, to the descending chamber 38 of the boom actuator 24 via the descending line 56, and to the hydraulic fluid reservoir 40 via the tank line 58. The ascending line 54 has a load holding poppet valve arrangement 60 to prevent excessive leakage of oil from the ascending side chamber across the first directional control valve 44A.

The first directional control valve 44A has a first ascending state 48A, a first neutral state 52A and a descending state 50. The second directional control valve 44B has a second ascending state 48B, a second neutral state 52B and a float state 62.

The first ascending state 48A is configured to connect the first feed line 46A to the ascending line 54 (i.e. to direct hydraulic fluid from the first pump 42A to the ascending chamber 36 to move the boom 22 in the ascending direction). Similarly, the second ascending state 48B is configured to connect the second feed line 46B to the ascending line 54 (i.e. to direct hydraulic fluid from the second pump 42B to the ascending chamber 36 to move the boom 22 in the ascending direction).

In the illustrated embodiment, the first ascending state 48A is also configured to connect the descending line 56 to the tank line 58 (i.e. to connect the descending chamber 38 to the hydraulic fluid reservoir 40). In alternative embodiments, the second ascending state 48B is configured to connect the descending line 56 to the tank line 58 (i.e. to connect the descending chamber 38 to the hydraulic fluid reservoir 40). In alternative embodiments, both the first and second ascending states 48A, 48B are configured to connect the descending line 56 to the tank line 58 (i.e. to connect the descending chamber 38 to the hydraulic fluid reservoir 40). In this way, as hydraulic fluid from the first and/or second pumps 42A, 42B enters the ascending chamber 36, hydraulic fluid is flushed from the descending chamber 38 to the hydraulic fluid reservoir 40, which prevents a build-up of pressure in one or both chambers 36, 38.

The descending state 50 is configured to connect the first feed line 46A to the descending line 56 (i.e. to direct hydraulic fluid from the first pump 42A to the descending chamber 38 to move the boom 22 in the descending direction). The descending state 50 is also configured to connect the ascending line 54 to the tank line 58 (i.e. to connect the ascending chamber 38 to the hydraulic fluid reservoir 40). In this way, as hydraulic fluid from the first pump 42A enters the descending chamber 38, hydraulic fluid is flushed from the ascending chamber 36 to the hydraulic fluid reservoir 40, which prevents a build-up of pressure in one or both chambers 36, 38.

The first neutral state 52A is configured to disconnect the first feed line 46A from the ascending line 54 and the descending line 56 (i.e. so that the first pump 42A is isolated from the ascending chamber 36 and the descending chamber 38). Similarly, the second neutral state 52B is configured to disconnect the second feed line 46B from the ascending line 54 and the descending line 56 (i.e. so that the second pump 42B is isolated from the ascending chamber 36 and the descending chamber 38).

In the embodiment illustrated in FIG. 2, the float state 62 is configured to connect the ascending line 54 and the descending line 56 to the tank line 58 (i.e. to connect the ascending and descending chambers 36, 38 to the hydraulic reservoir 40). By connecting the ascending chamber 36 to the hydraulic fluid reservoir 40, hydraulic fluid is permitted to flow out of the ascending chamber 36 and into the hydraulic fluid reservoir 40. In other words, the boom 22 is permitted to move freely in the descending direction. Similarly, by connecting the descending chamber 38 to the hydraulic fluid reservoir 40, hydraulic fluid is permitted to flow out of the descending chamber 38 and into the hydraulic fluid reservoir 40. In other words, the boom 22 is permitted to move freely in the ascending direction.

The float state 62 is also configured to connect the ascending line 54 to the descending line 56 (i.e. to connect the ascending chamber 36 to the descending chamber 38). By connecting the ascending chamber 36 to the descending chamber 38, hydraulic fluid is permitted to flow between these chambers 36, 38. Therefore, when an external force is exerted on the rod 30 of the boom actuator 24 (e.g. to push the piston 28 separating the two chambers 36, 38), hydraulic fluid will be pushed out of one chamber and into the other. This allows the boom 22 to move freely in either direction. Furthermore, by allowing hydraulic fluid to flow between the two chambers 36, 38 in float mode 62, rather than independently connecting these chambers 36, 38 to the hydraulic fluid reservoir 40, the hydraulic fluid in the ascending and/or descending chambers 36, 38 can be maintained at a higher pressure than the hydraulic fluid reservoir 40. In other words, there is a "regenerative flow" between the chambers 36, 38. This allows the boom actuator 24 to be controlled more quickly after the second directional control valve 44B transitions out of the float state 62.

The way in which first and second directional control valves 44A, 44B direct hydraulic fluid around the hydraulic system 34 in order to control movement of the boom 22 is summarized below.

Ascending configuration: moving the boom 22 in the ascending direction via setting the first directional control valve 44A to the first ascending state 48A, and setting the second directional control valve 44B to the second ascending state 48B.

Neutral configuration: maintaining the position of the boom 22 via setting the first directional control valve 44A to the first neutral state 52A, and setting the second directional control valve 44B to the second neutral state 52B.

Descending configuration: moving the boom 22 in the descending direction via setting the first directional control valve 44A to the descending state 50, and setting the second directional control valve 44B to the second neutral state 52B.

Floating configuration: permitting the boom 22 to move freely via setting the second directional control valve 44B to the float state 62, and setting the first directional control valve 44A to the first neutral state 52A.

In the illustrated embodiment, the float state 62 includes an orifice 64 configured to restrict the flow of hydraulic fluid from the ascending line 54 and the descending line 56 to the tank line 58 (i.e. to restrict the flow of hydraulic fluid to the hydraulic fluid reservoir 40 from the ascending chamber 36 and the descending chamber 38). In alternative embodiments, the orifice 64 may be positioned in the tank line 58 (e.g. positioned between the hydraulic fluid reservoir 40 and the second directional control valve 44B). By restricting the flow of hydraulic fluid to the hydraulic fluid reservoir 40, the boom 22 moves in the descending and/or ascending direction more slowly. This prevents the boom 22 from lifting or descending too quickly when the second directional control valve 44B is in the float state 62, which reduces the risk of accidents (e.g. crushing under the boom 22) or damage to the working machine 10. By restricting the flow of hydraulic fluid from the ascending and descending lines 54, 56 to the hydraulic fluid reservoir 40, the orifice 64 also encourages regenerative flow between the ascending and descending chambers 36, 38, and allows these chambers to be maintained at a higher pressure than the hydraulic fluid reservoir 40 (i.e. pressure is higher upstream of the orifice 64 than downstream of the orifice 64).

In the illustrated embodiment, the first and second directional control valves 44A, 44B are directional spool valves which are spring-biased towards their respective first and second neutral states 52A, 52B. The first and second directional control valves 44A, 44B are also pilot-operated valves, which provides a simple means of overcoming the spring biasing force to move the valves away from their neutral states 52A, 52B. More specifically, the first directional control valve 44A includes a first pressure port 70A configured to receive hydraulic fluid to move the first directional control valve 44A to the first ascending state 48A, and a second pressure port 72A configured to receive hydraulic fluid to move the first directional control valve 44A to the descending state 50. Similarly the second directional control valve 44B includes a third pressure port 70B configured to receive pressurized hydraulic fluid to move the second directional control valve 44B to the second ascending state 48B, and a fourth pressure port 72B configured to receive pressurized hydraulic fluid to move the second directional control valve 44B to the float state 62.

The hydraulic system 34 includes a control system configured to change the state of the first and second directional control valves 44A, 44B via directing hydraulic fluid to the pressure ports 70A, 70B, 72A, 72B. In alternative embodiments, the first and second directional control valves 44A, 44B may be solenoid operated, and the control system may be configured to change the state of the first and second directional control valves 44A, 44B via actuating solenoids of the first and second control valves 44A, 44B.

In the illustrated embodiment, the control system includes the following components: ascending pressure sensor 66; descending pressure sensor 68; dedicated pilot pump 74; pilot feed line 76; a plurality of pilot control valves in the form of a first pilot control valve 78 and floating selection valves 90A, 90B; ascending pilot line 84, alternative function pilot line 88, descending pilot line 92 and float pilot line 94.

The dedicated pilot pump 74 is connected to the first pilot control valve 78 via the pilot feed line 76. In alternative embodiments, the dedicated pilot pump 74 may be omitted and the pilot feed line 76 may branch off from the first or second feed lines 46A, 46B.

The first pilot control valve 78 is connected to the first pressure port 70A and third pressure port 70B via the ascending pilot line 84. The first pilot control valve 78 is also connected to the floating selection valves 90A, 90B via the alternative function pilot line 88. The floating selection valves 90A, 90B are connected to the second pressure port 72A via the descending pilot line 92, and to the fourth pressure port 72B via the float pilot line 94.

The first pilot control valve 78 has a third neutral state 80, a third ascending state 82, and an alternative function state 86. The initial state of the first pilot control valve 78 (i.e. the state when no inputs of the user controls 20 are actuated) is the third neutral state 80. In the illustrated embodiment, the state of the first pilot control valve 78 is controlled via a joy stick in the controls section 20 of the cab 18 of the working machine 10. In other embodiments, the state of the first pilot control valve 78 may be set by the control system.

The third neutral state 80 is configured to connect the ascending pilot line 84 and the alternative function pilot line 88 to the hydraulic reservoir 40 (i.e. to connect the pressure ports 70A, 70B, 72A, 72B to the hydraulic fluid reservoir 40, so that the first and second directional control valves 44A, 44B are pushed to their respective first and second neutral states 52A, 52B by the spring-biasing action).

The third ascending state 82 is configured to connect the pilot feed line 76 to the ascending pilot line 84 (i.e. to direct hydraulic fluid from the dedicated pilot pump 74 to the first and third pressure ports 70A, 70B, in order to move the first and second directional control valves 44A, 44B to their respective first and second ascending states 48A, 48B).

In the illustrated embodiment, the ascending pilot line 84 includes a first check valve 85A which permits hydraulic fluid to flow from the third pressure port 70B to the first pilot control valve 78, but inhibits a flow of hydraulic fluid in the opposite direction. The ascending pilot line 84 also includes a second check valve 85B which permits hydraulic fluid to flow from the first pilot control valve 78 to the third pressure port 70B, but inhibits a flow of hydraulic fluid in the opposite direction. The second check valve 85B is a spring loaded check valve. Therefore, hydraulic fluid is only permitted to flow from the first pilot control valve 78 to the third pressure port 70B if the pressure in the ascending pilot line 84 is great enough to overcome the spring biasing force of the second check valve 85B. In this way, when the boom 22 only needs to move slowly (e.g. the joy-stick in the controls section 20 is only moved slightly from its neutral position), the pressure in the ascending pilot line 84 is not great enough overcome the spring biasing force of the second check valve 85B, and the boom 22 is controlled only via the first pump 42A and first directional control valve 44A. However, when the boom 22 needs to move quickly (e.g. the joy-stick in the controls section 20 is moved a long way from its neutral position), the pressure in the ascending pilot line 84 is great enough overcome the spring biasing force of the second check valve 85B, and the boom 22 is controlled via both the first and second pumps 42A, 42B and first and second directional control valves 44A, 44B.

In alternative embodiments, the first and second check valves 85A, 85B may be omitted, so that both the first and second pumps 42A, 42B and first and second directional control valves 44A, 44B are always used simultaneously to move the boom 22 in the ascending direction.

The alternative function state 86 is configured to connect the pilot feed line 76 to the alternative function pilot line 88 (i.e. to direct hydraulic fluid from the dedicated pilot pump 74 to the floating selection valves 90A, 90B).

The first floating selection valve 90A has a first selection state 91A and a second selection state 93A. The first selection state 91A is configured to connect the alternative function pilot line 88 to the second floating selection valve 90B. The second selection state 93A is configured to connect the second floating selection valve 90B to the hydraulic fluid reservoir 40. In this way, the first floating selection valve 90A acts as an binary switching valve to either allow a flow of hydraulic fluid from the dedicated pilot pump 74 to the second floating selection valve 90B (i.e. when in the first selection state 91A), or inhibit flow of hydraulic fluid from the dedicated pilot pump 74 to the second floating selection valve 90B (i.e. when in the second selection state 93A). In other words, the second selection state 93A can be used to isolate the second and fourth pressure ports 72A, 72B so that the first directional control valve 44A is not permitted to transition to the descending state 50 and the second directional control valve 44B is not permitted to transition to the float state 62).

The first floating selection valve 90A is spring-biased towards the first selection state 91A and includes a solenoid which can be actuated by the control system to move the first floating selection valve 90A to the second selection state 93A. Therefore, the first floating selection valve 90A is a backup valve which allows the control system to quickly depressurize the descending pilot line 92 or float pilot line 94 (downstream of the second floating selection valve 90B) to ensure the first directional control valve 44A and second directional control valve 44B are both in their respective first and second neutral states 52A, 52B (e.g. if the control system detects an unsafe condition of the working machine 10).

The second floating selection valve 90B has a third selection state 91B and a fourth selection state 93B. The third selection state 91B is configured to connect the first floating selection valve 90A to the descending pilot line 92, and to connect the float pilot line 94 to the hydraulic fluid reservoir 40. The fourth selection state 93B is configured to connect the first floating selection valve 90A to the float pilot line 94, and to connect the descending pilot line 92 to the hydraulic fluid reservoir 40. In this way, the second floating selection valve 90B acts as a binary switching valve which permits one of the second pressure port 72A or the fourth pressure port 72B to be connected to the first floating selection valve 90A, and the other of the second pressure port 72A and fourth pressure port 72B to be connected to the hydraulic fluid reservoir 40.

The way in which pilot control valves 78, 90A, 90B direct hydraulic fluid around the pilot lines 84, 88, 92, 94 in order to control the state of the first and second directional control valves 44A, 44B is summarized below.

Configuration 1: When the first pilot control valve 78 is in the third ascending state 82, hydraulic fluid is directed from the dedicated pilot pump 74, along pilot feed line 76, through the third ascending state 82, along ascending pilot line 84 and to the first pressure port 70A, so that the first directional control valve 44A is moved to its first ascending state 48A. If the pressure in the ascending pilot line 84 is great enough to overcome the spring biasing force of the second check valve 85B, hydraulic fluid will also be directed along ascending pilot line 84 to the third pressure port 70B, so that the second directional control valve 44B is moved to its second ascending state 48B. Irrespective of the state of the floating selection valves 90A, 90B, the descending pilot line 92 and float pilot line 94 are both depressurized via a connection to the hydraulic fluid reservoir 40 (either via the second selection state 93A, or via the third ascending state 82).

Configuration 2: When the first pilot control valve 78 is in the third neutral state 80, the ascending pilot line 84, descending pilot line 92 and float pilot line 94 are all depressurized via a connection to the hydraulic fluid reservoir 40 (either via the second selection state 93A, or via the third neutral state 80).

Configuration 3: When the first pilot control valve 78 is in the alternative function state 86, the first floating selection valve 90A is in the first selection state 91A and the second floating selection valve 90B is in the third selection state 91B, the pilot feed line 76 is connected to the alternative function pilot line 88, which is connected to the descending pilot line 92 via the first and third selection states 91A, 91B (i.e. hydraulic fluid is directed from the dedicated pilot pump 74 to the second pressure port 72A, in order to move the first directional control valve 44A to the descending state 50). The float pilot line 94 is connected to the hydraulic fluid reservoir 40 via the first selection state 91B, so that the second directional control valve 44B is not permitted to move to the float state 62.

Configuration 4: When the first pilot control valve 78 is in the alternative function state 86, the first floating selection valve 90A is in the first selection state 91A and the second floating selection valve 90B is in the fourth selection state 93B, the pilot feed line 76 is connected to the alternative function pilot line 88, which is connected to the float pilot line 94 via the first and fourth selection states 91A, 93B (i.e. the dedicated pilot pump 74 directs hydraulic fluid to the fourth pressure port 72B, in order to move the second directional control valve 44B to the float state 62). The descending pilot line 92 is connected to the hydraulic fluid reservoir 40 via the fourth selection state 93B, so that the first directional control valve 44A is not permitted to move to the descending state 50.

Configuration 5: When the first pilot control valve 78 is in the alternative function state 86 and the first floating selection valve 90A is in the second selection state 93A, either the descending pilot line 92 or the float pilot line 94 is connected to the hydraulic fluid reservoir 40 via the second selection state 93A and the other of the descending pilot line 92 or the float pilot line 94 is connected to the hydraulic fluid reservoir 40 via the third or fourth selection states 91B, 93B. In this way, the first directional control valve 44A is not permitted to move to the descending state 50, and the second directional control valve 44B is not permitted to move to the float state 62.

In any of configurations 3 to 5, the ascending pilot line 84 is depressurized via a connection to the hydraulic fluid reservoir 40 (via the alternative function state 86), so that neither of the first and second directional control valves 44A, 44B are permitted to move to their respective first and second ascending states 48A, 48B.

In alternative embodiments, the first floating selection valve 90A may be omitted and flow of hydraulic fluid from the descending pilot line 92 and float pilot line 94 to the hydraulic fluid reservoir 40 may be only via the third and fourth selection states 91B, 93B or the third neutral or ascending states 80, 82 of the first pilot control valve 78.

As will be described in more detail below, the control system is configured to permit the second directional control valve 44B to transition to the float state 62 (via movement of the pilot control valves 78, 90A, 90B, for example, to configuration 4 outlined above) when a float selection input in the controls section 20 of the cab 18 of the working vehicle 10 is actuated. In this way, a user is able to selectively switch to the float state 62 when undertaking a machine operation which requires the boom 22 to operate in a floating mode.

The control system is configured to detect a state of the boom actuator 24 and to permit the second directional control valve 44B to transition to the float state 62 if one or more entry conditions are satisfied. By requiring one or more entry conditions to be satisfied, the second directional control valve 44B may not enter the float state 62 when it would be dangerous to do so or risk damaging equipment. For example, if the boom 22 is in the air with a heavy load, it may fall down too quickly in float mode which could result in a person or object being crushed, or damage to the working machine 10. Similarly, if the boom 22 is descended beyond the bottom of the tracks 16 of the working machine 10 so that the chassis 12 is jacked upwards from the ground, entering float mode could result in the chassis 12 falling quickly to the ground which could result in injury to an operator located in the cab 18, or damage to the working machine 10.

The ascending pressure sensor 66 is configured to detect pressure in the ascending chamber 36 and the descending pressure sensor 68 is configured to detect pressure in the descending chamber 38. The control system is configured to permit the second directional control valve 44B to transition to the float state 62 if a pressure differential between the ascending chamber 36 and the descending chamber 38 is less than a threshold value. By comparing the relative pressure between the two chambers 36, 38, it is possible to determine if the boom 22 is in the air (i.e. pressure in the ascending chamber 36 is significantly higher than the descending chamber 38), or jacking up the chassis 12 of the working machine 10 (i.e. pressure in the descending chamber 38 is significantly higher than the ascending chamber 36). In the preferred embodiment, the threshold value is 10 bar. In alternative embodiments, the threshold value may be any value above 5 bar.

The control system is configured to provide an alert to the controls section 20 in the cab 18 of the working vehicle 10 if a float selection input of the controls section 20 is actuated and one or more entry conditions are not satisfied (i.e. the pressure differential between the ascending chamber 36 and the descending chamber 38 is greater than the threshold value). By providing such an alert, the user is made aware that they need to adjust the position of the boom 22 until the entry conditions are met (e.g. moving the boom 22 downwards until the implement 14 is resting on the ground).

The control system is also configured to inhibit the second directional control valve 44B from transitioning to the float state 62 if a float selection input of the controls section 20 is actuated and one or more entry conditions are not satisfied (i.e. the pressure differential between the ascending chamber 36 and the descending chamber 38 is greater than the threshold value). Inhibiting the second directional control valve 44B from transitioning to the float state 62 if the entry conditions are not satisfied offers an added safety benefit, since it is not possible to enter float mode unless it is safe to do so (e.g. even if the operator ignores the alert).

In alternative embodiments, only one of the alert or inhibition of transition to the float state 62 may be provided in response to one or more entry conditions not being satisfied.

In alternative embodiments, other entry conditions must be satisfied instead of, or in addition to, ensuring the pressure differential between the ascending chamber 36 and the descending chamber 38 is less than the threshold value. For example, a proximity sensor may be provided on the implement 14 to determine whether it is resting on the ground, and a proximity sensor may be provided at a front end of the tracks 16 to determine whether the tracks 16 and chassis 12 are jacked off the ground.

Figure 3:
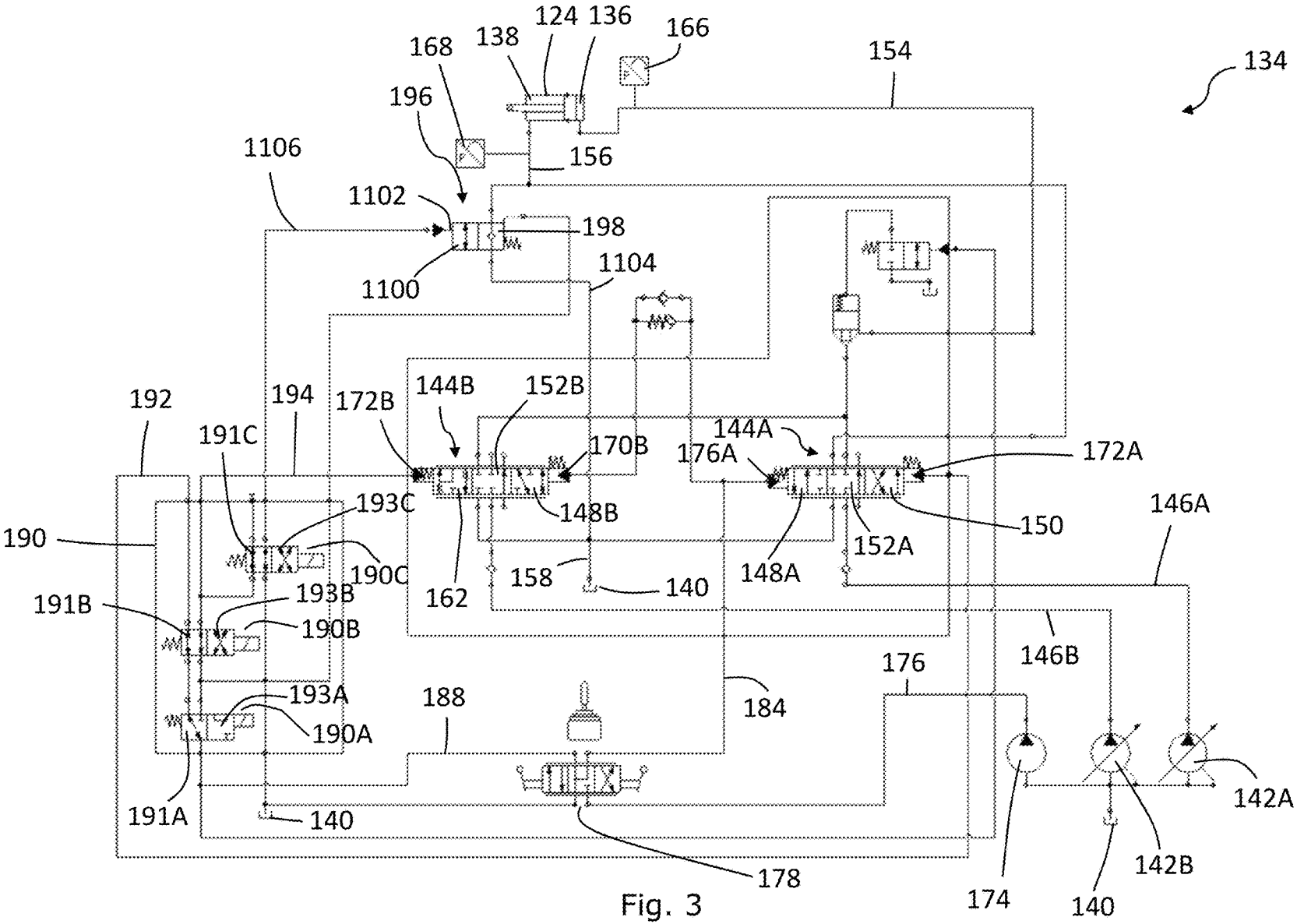
FIG. 3 is a hydraulic system for the working machine of FIG. 1, according to an alternative embodiment.

Referring now to FIG. 3, an alternative hydraulic system for the working machine 10 of FIG. 1 is indicated at 134. Corresponding components between the hydraulic systems of FIGS. 3 and 2 are labelled with the prefix "1", and only differences are discussed.

The hydraulic system 134 includes a float valve 196 with a fifth pressure port 1102, a float line 1104, a third floating selection valve 190C having fifth and sixth selection states 191C, 193C, and a float valve pilot line 1106.

The float line 1104 provides a connection between the descending line 156 and the tank line 158. The float valve 196 is provided in the float line 1104 to selectively block or open the float line 1104.

The float valve 196 has a blocked state 198 and an open state 1100. The blocked state 198 is configured to block the float line 1104 to disconnect the descending line 156 from the tank line 158 (i.e. to disconnect the descending chamber 138 from the hydraulic fluid reservoir 140). In the illustrated embodiment, the blocked state 198 includes a check-valve which inhibits a flow of hydraulic fluid from the descending line 156 to the tank line 158, but permits one way flow of hydraulic fluid from the tank line 158 to the descending line 156. This helps prevent negative pressure being formed within the descending chamber 138 when the volume of the descending chamber increases (e.g. due to movement of the boom 22 in the descending direction during a float mode). In alternative embodiments, the blocked state 198 may inhibit flow of hydraulic fluid between the descending line 156 and the tank line 158 in both directions.

The open state 1100 is configured to open the float line 1104 to connect the descending line 156 to the tank line 158 (i.e. to connect the descending chamber 138 to the hydraulic fluid reservoir 140).

The float state 162 of the second directional control valve 144B is only connected to the ascending line 154 and the tank line 158 (i.e. it is not connected to the descending line 156, as in FIG. 2). In other words, the float valve 196 is configured to connect or disconnect the descending chamber 138 to the hydraulic fluid reservoir 140 independently of the second directional control valve 1448, and the float state 162 is configured to connect or disconnect the ascending chamber 136 to the hydraulic fluid reservoir 140 independently of the float valve 196.

Having a float valve 196 and float state 162 that are each configured to connect only one of the ascending or descending chambers 136, 138 to the hydraulic fluid reservoir 140 provides a means of having a "single float" mode, where the boom 22 is permitted to move freely in only one of the descending and ascending directions, which may be advantageous for certain working machine 10 operations. For example, when the implement 14 is a hydraulic hammer drill, it may be desirable to allow the boom 22 to move downwards with gravity as a drilling surface is broken apart by the drill.

In this way, the chambers 136, 138 can be put in "float" mode separately or in tandem. In other words, this arrangement allows "single float" in the ascending chamber 136 (i.e. free movement of the boom 22 in the descending direction), "single float" in the descending chamber 138 (i.e. free movement of the boom 22 in the ascending direction) or "dual float" in both chambers (i.e. free movement of the boom 22 in either direction).

In alternative embodiments, the float line 1104 may connect the ascending line 154, rather than the descending line 156, to the tank line 158. In such embodiments, the float state 162 of the second directional control valve 1448 would only be connected to the descending line 154 and the tank line 158 (i.e. it would not be connected to the ascending line 154). Similarly, this arrangement would allow "dual float" mode, or "single float" mode in either the ascending or descending chamber 136, 138.

The float valve 196 is spring-biased towards the blocked state 198, and the fifth pressure port 1102 is configured to receive pressurized hydraulic fluid to move to the open state 1100.

The float valve pilot line 1106 connects the float pilot line 194 to the fifth pressure port 1102. The third floating selection valve 190C is provided on the float valve pilot line 1106 (i.e. between the float pilot line 194 and the fifth pressure port 1102).

The fifth selection state 191C is configured to connect the float valve pilot line 1106 to the hydraulic fluid reservoir 140 (i.e. so that the float valve 196 is pushed by the spring-biasing force to the blocked state 198). The sixth selection state 193C is configured to connect the float valve pilot line 1106 to the float pilot line 194 (i.e. so that the float valve 196 is pushed to the open state 1100 when the second directional control valve 144B is pushed to the float state 162, depending on the state of the first and second floating selection valves 190A, 190B). In other words, this embodiment allows the float state 162 and open state 1100 to be selected simultaneously (i.e. "dual float" mode), or the float state 162 to be selected with the blocked state 198 (i.e. "single float" in the descending direction), but not the open state 1100 to be selected without the float state 162 (i.e. no "single float" in the ascending direction). In alternative embodiments, a different floating selection valve arrangement 190A, 1906, 190C may permit "single float" in the ascending direction.

In the illustrated embodiment, the floating selection valves 190A, 190B, 190C are provided in a floating selection valve block 190. In alternative embodiments, the floating selection valves 190A, 1906, 190C may be provided as independent valves.

Figure 4:
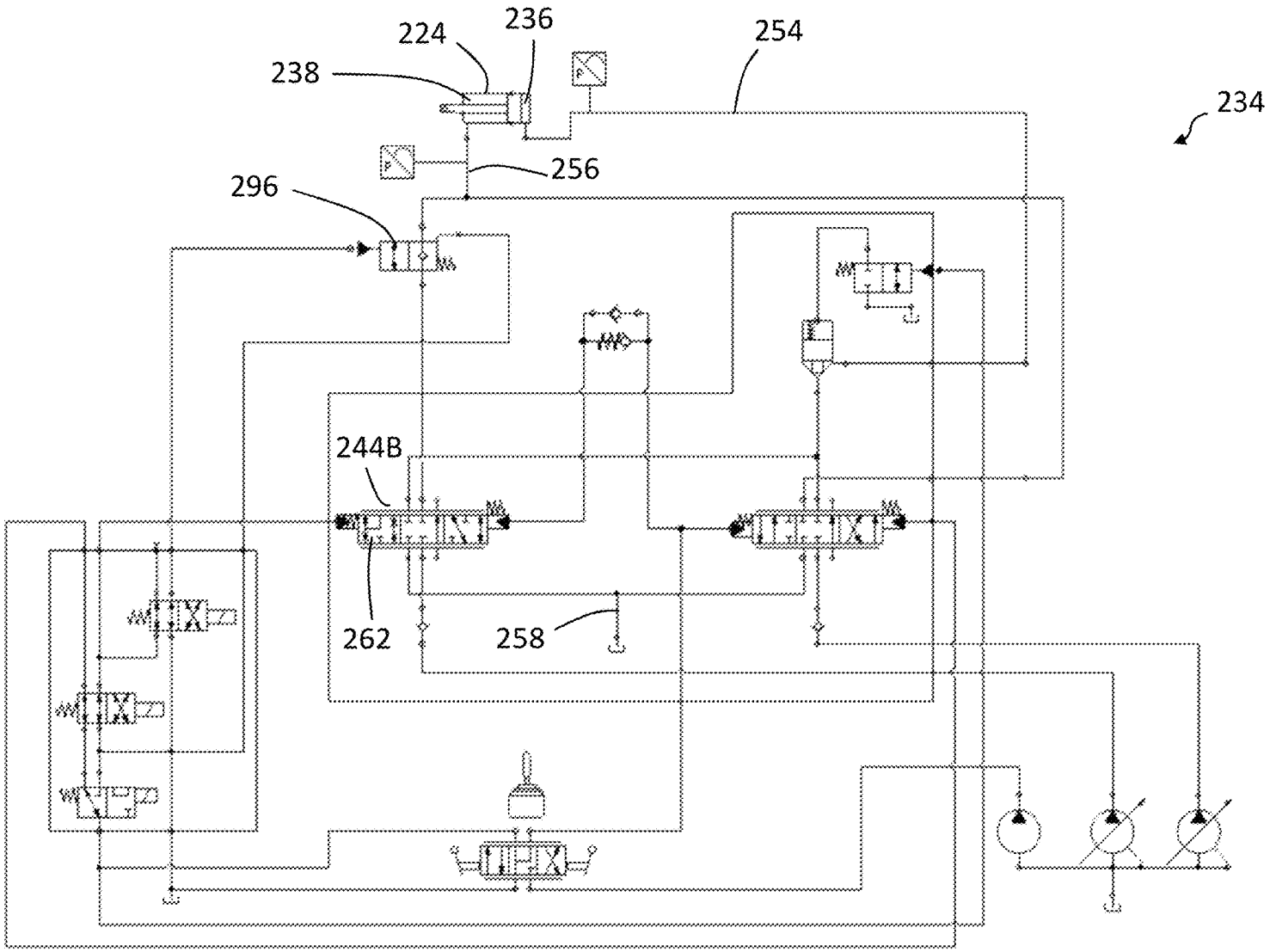
FIG. 4 is a hydraulic system for the working machine of FIG. 1, according to an alternative embodiment.

Referring now to FIG. 4, an alternative hydraulic system for the working machine 10 of FIG. 1 is indicated at 234. Corresponding components between the hydraulic systems of FIGS. 4, 3 and 2 are labelled with the prefix "2", and only differences are discussed.

In the illustrated embodiment, the float valve 296 is provided between the descending line 256 and the second directional control valve 244B (i.e. there is no float line 1104 between the descending line 256 and the tank line 258, as in FIG. 3). In other words, the float valve 296 connects the descending line 256 to the tank line 258 through the float state 262 of the second directional control valve 244B. Therefore, this arrangement permits either "dual float" mode, or "single float" mode in the descending direction, but not "single float" mode in the ascending direction.

The ascending line 254 and descending line 256 are connected via the float state 262 (as in the embodiment of FIG. 2). Therefore, when the float valve 296 is in the open state 2100 and the second directional control valve 244B is in the float state 262, a regenerative flow of hydraulic fluid is permitted between the ascending and descending chambers 236, 238.

Figure 5:
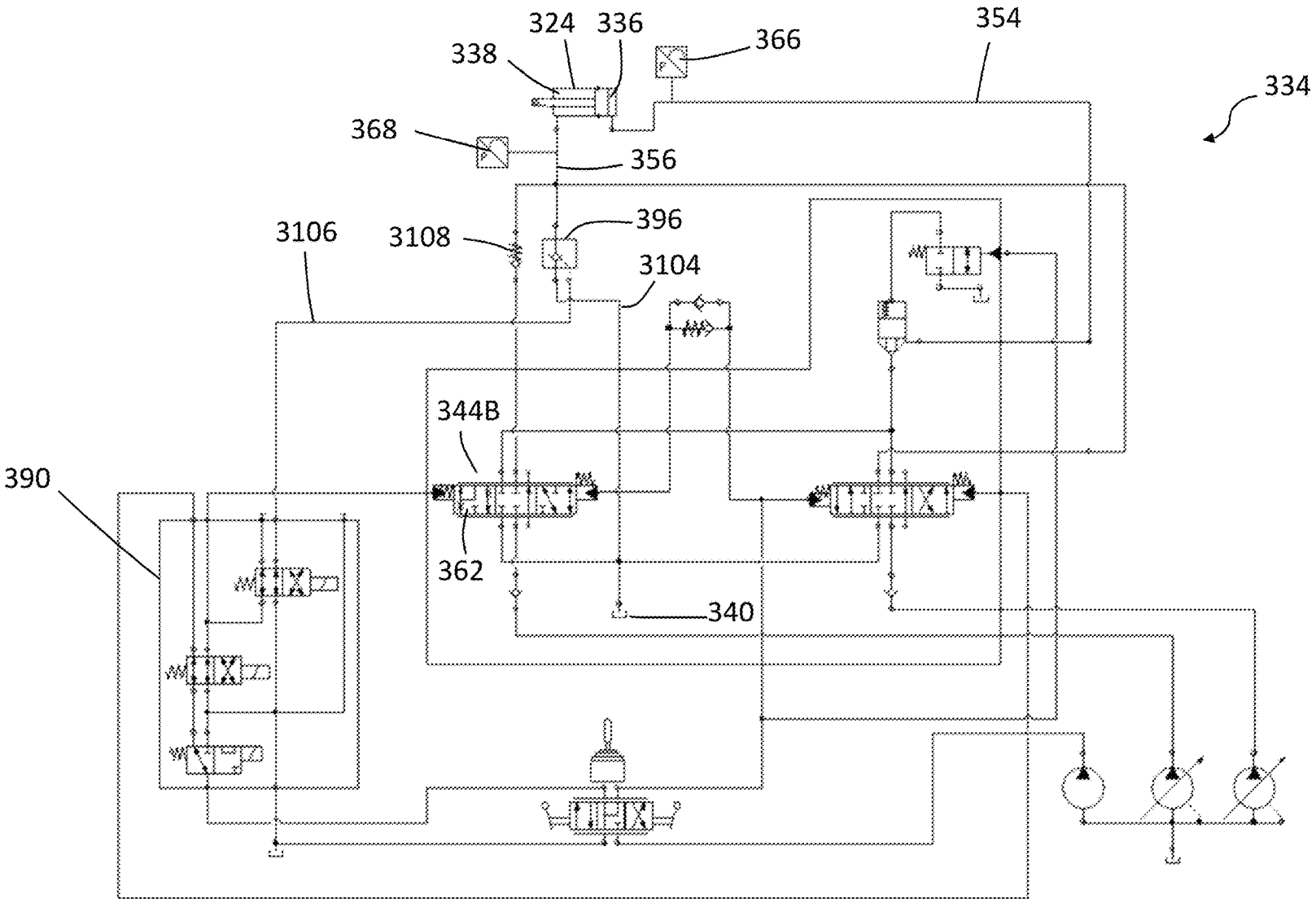
FIG. 5 is a hydraulic system for the working machine of FIG. 1, according to an alternative embodiment.

Referring now to FIG. 5, an alternative hydraulic system for the working machine 10 of FIG. 1 is indicated at 334. Corresponding components between the hydraulic systems of FIGS. 5, 4, 3 and 2 are labelled with the prefix "3", and only differences are discussed.

The hydraulic system 334 of this embodiment is similar to the hydraulic system 134 of FIG. 3. The main difference is that this embodiment includes a third check valve 3108 between the second directional control valve 344B and the descending line 356. The third check valve 3108 only permits a one way flow of hydraulic fluid from the float state 362 of the second directional control valve 344B to the descending line 356. In this way, regenerative flow of hydraulic fluid is permitted from the ascending chamber 336 to the descending chamber 338 (via the float state 362 and the third check valve 3108), but regenerative flow between the descending chamber 338 and the ascending chamber 336 is not permitted. Similarly, a flow of hydraulic fluid from the descending line 356 to the hydraulic fluid reservoir 340 is only permitted via the float valve 396 and float line 3104 (i.e. flow of hydraulic fluid from the descending line 356 to the hydraulic fluid reservoir 340 is not permitted via the float state 362).

Another difference between this embodiment and that of FIG. 3 is that the float valve 396 is a pilot-operated check valve. However, this still has a blocked state (when float valve pilot line 3106 is not pressurized) and an open state (when float valve pilot line 3106 is pressurized), and functions in much the same way as the float valve 196 described above.

Although the invention has been described in relation to one or more embodiments, it will be appreciated that various changes or modifications can be made without departing from the scope of the invention as defined in the appended claims. For example:

more than one boom actuator 24 may be provided to move the boom 22;

the first and second directional control valves 44A, 44B and/or float valve 196 may be solenoid operated, rather than pilot-operated;

the first pilot control valve 78, floating selection valves 90A, 90B, 190C and pilot lines 76, 84, 88, 92, 94 may be alternatively configured in order to control the state of the first and second directional control valves 44A, 44B and/or float valve 196;

the load holding poppet valve arrangement 60 may be omitted;

one or more additional check valves and/or orifices may be provided to regulate flow and pressure in the hydraulic system;

the first pilot control valve 78 and floating selection valves 90A, 90B, 390C may be manually operated (e.g. operated by a push button, joystick, lever or the like) or solenoid operated;

a regenerative flow line having a regenerative flow valve may be positioned between the ascending line 54 and descending line 56;

the hydraulic system may be provided for controlling other actuators of a working machine 10 (e.g. one of actuators 32, 33); and the working machine 10 may be any type of working machine having a working arm 13 (e.g. a slew excavator, backhoe loader or the like).

The invention claimed is:

1. A hydraulic system for a working machine of the kind having a chassis and a boom pivotally attached to the chassis, the hydraulic system comprising:

a hydraulic fluid reservoir;

a boom actuator configured to move the boom in an ascending direction and a descending direction, the boom actuator having an ascending chamber and a descending chamber;

a first pump;

a first directional control valve comprising a first ascending state configured to direct hydraulic fluid from the first pump to the ascending chamber to move the boom in the ascending direction, a descending state configured to direct hydraulic fluid from the first pump to the descending chamber to move the boom actuator in the descending direction, and a first neutral state where the first pump is isolated from the ascending chamber and the descending chamber;

a second pump;

a second directional control valve comprising a second ascending state configured to direct hydraulic fluid from the second pump to the ascending chamber to move the boom actuator in the ascending direction, and a second neutral state where the second pump is isolated from the ascending chamber and the descending chamber; and wherein the second directional control valve further comprises a float state configured to connect at least one of the ascending and descending chambers to the hydraulic reservoir for permitting the boom to move freely in the descending and/or ascending directions;

further comprising a float valve, the float valve comprising a blocked state and an open state, the blocked state configured to disconnect a selected one of the ascending or descending chambers from the hydraulic fluid reservoir, and the open state configured to connect the selected one of the ascending and descending chambers to the hydraulic fluid reservoir, the float valve being configured for selectively permitting the boom to move freely in the descending direction or in the ascending direction.

2. The hydraulic system according to claim 1, wherein the hydraulic system is configured to permit the boom to move freely by setting the first directional control valve to the first neutral state and setting the second directional control valve to the float state.

3. The hydraulic system according to claim 1, wherein the float state of the second directional control valve is configured to connect the ascending chamber and descending chamber to the hydraulic fluid reservoir.

4. The hydraulic system according to claim 1, wherein the float state of the second directional control valve is configured to connect one of the ascending or descending chambers to the hydraulic fluid reservoir, and wherein the float valve is configured to connect or disconnect the other of the ascending and descending chambers to the hydraulic fluid reservoir independently of the second directional control valve.

5. The hydraulic system according to claim 1, wherein the float state of the second directional control valve is configured to connect the ascending chamber and the descending chamber to the hydraulic fluid reservoir, and wherein the float valve is configured to connect or disconnect one of the ascending or descending chambers to the hydraulic fluid reservoir via the second directional control valve when in the float state.

6. The hydraulic system according to claim 1, wherein the float state of the second directional control valve is configured to connect the ascending chamber to the descending chamber.

7. The hydraulic system according to claim 1, wherein the float state of the second directional control valve comprises an orifice configured to restrict the flow of hydraulic fluid to the hydraulic fluid reservoir from the ascending chamber and/or the descending chamber; and/or wherein the hydraulic system further comprises an orifice positioned between the hydraulic fluid reservoir and the second directional control valve, wherein said orifice is configured to restrict the flow of hydraulic fluid to the hydraulic fluid reservoir from the ascending chamber and/or the descending chamber.

8. The hydraulic system according to claim 1, wherein the first ascending state of the first directional control valve or the second ascending state of the second directional control valve is further configured to connect the descending chamber to the hydraulic fluid reservoir.

9. The hydraulic system according to claim 1, wherein the descending state of the first directional control valve is further configured to connect the ascending chamber to the hydraulic fluid reservoir.

10. The hydraulic system according to claim 1, further comprising a control system configured to change the state of the first and second directional control valves.

11. The hydraulic system according to claim 10, wherein the control system is configured to permit the second directional control valve to transition to the float state when a float selection input of a working vehicle is actuated.

12. The hydraulic system according to claim 11, wherein the control system is configured to detect a state of the boom actuator and to permit the second directional control valve to transition to the float state if one or more entry conditions are satisfied.

13. The hydraulic system according to claim 12, wherein the control system comprises an ascending pressure sensor configured to detect pressure in the ascending chamber and a descending pressure sensor configured to detect pressure in the descending chamber, and wherein the control system is configured to permit the second directional control valve to transition to the float state if a pressure differential between the ascending chamber and the descending chamber is less than a threshold value; optionally, wherein the threshold value is greater than 5 bar; optionally, wherein the threshold value is 10 bar.

14. The hydraulic system according to claim 12, wherein the control system is configured to provide an alert to a working vehicle if a float selection input is actuated and one or more entry conditions are not satisfied.

15. The hydraulic system according to claim 1, wherein the first directional control valve and the second directional control valve are directional spool valves; optionally, wherein the first directional control valve is spring-biased towards the first neutral state and the second directional control valve is spring-biased towards the second neutral state; optionally, wherein the first directional control valve and second directional control valve are pilot-operated valves; optionally, wherein the first directional control valve comprises a first pressure port configured to receive hydraulic fluid to move the first directional control valve to the first ascending state, and a second pressure port configured to receive hydraulic fluid to move the first directional control valve to the descending state; optionally, wherein the second directional control valve comprises a third pressure port configured to receive pressurized hydraulic fluid to move the second directional control valve to the second ascending state, and a fourth pressure port configured to receive pressurized hydraulic fluid to move the second directional control valve to the float state; optionally, further comprising one or more pilot control valves configured to selectively direct hydraulic fluid to the first, second, third and fourth pressure ports; optionally, wherein the one or more pilot control valves comprise a first pilot control valve comprising a third ascending state configured to direct hydraulic fluid to the first and third pressure ports; optionally, wherein the first pilot control valve is manually operated via a joystick or the like; optionally, wherein the one or more pilot control valves further comprise one or more floating selection valves configured to direct hydraulic fluid to either the second pressure port or the fourth pressure port; optionally, wherein the one or more pilot control valves comprise a first pilot control valve comprising a third ascending state configured to direct hydraulic fluid to the first and third pressure ports, and an alternative function state configured to direct hydraulic fluid to the one or more floating selection valves; optionally, further comprising a float valve comprising: a blocked state configured to disconnect one of the ascending and descending chambers from the hydraulic fluid reservoir and an open state configured to connect said one of the ascending and descending chambers to the hydraulic fluid reservoir, wherein the float valve is spring-biased towards the blocked state and further comprises a fifth pressure port configured to receive pressurized hydraulic fluid to move to the open state, and wherein the one or more floating selection valves are further configured to selectively direct hydraulic fluid to the fourth and/or fifth pressure ports, or the second pressure port; optionally, wherein the one or more floating selection valves are solenoid-operated, and wherein the hydraulic system further comprises a control system configured to actuate the one or more floating selection valves; optionally, further comprising a dedicated pilot pump configured to supply hydraulic fluid to the pressure ports.

16. The hydraulic system according to claim 1, in combination with a working machine.

17. A method of operating the hydraulic system of claim 1, the method comprising:

i) moving the boom in the ascending direction via setting the first directional control valve to the first ascending state, and setting the second directional control valve to the second ascending state;

ii) maintaining the position of the boom via setting the first directional control valve to the first neutral state, and setting the second directional control valve to the second neutral state;

iii) moving the boom in the descending direction via setting the first directional control valve to the descending state, and setting the second directional control valve to the second neutral state; and/or iv) permitting the boom to move freely via setting the second directional control valve to the float state, and setting the first directional control valve to the first neutral state; and providing the hydraulic system with a float valve comprising a blocked state and an open state, the blocked state configured to disconnect a selected one of the ascending and descending chambers from the hydraulic fluid reservoir, and the open state configured to connect the selected one of the ascending and descending chambers to the hydraulic fluid reservoir, and configuring the float valve configured for selectively permitting the boom to move freely in the descending direction or in the ascending direction, and wherein the float valve may be set to the open state.

18. A method comprising:

providing each of a hydraulic fluid reservoir, a boom actuator configured to move the boom in an ascending direction and a descending direction, the boom actuator having an ascending chamber and a descending chamber, a first pump, a first directional control valve comprising a first ascending state configured to direct hydraulic fluid from the first pump to the ascending chamber to move the boom in the ascending direction, a descending state configured to direct hydraulic fluid from the first pump to the descending chamber to move the boom actuator in the descending direction, and a first neutral state where the first pump is isolated from the ascending chamber and the descending chamber, a second pump, a second directional control valve comprising a second ascending state configured to direct hydraulic fluid from the second pump to the ascending chamber to move the boom actuator in the ascending direction, and a second neutral state where the second pump is isolated from the ascending chamber and the descending chamber;

providing the second directional control valve further with a float state configured to connect at least one of the ascending and descending chambers to the hydraulic reservoir for permitting the boom to move freely in the descending and/or ascending directions; and i) moving the boom in the ascending direction via setting the first directional control valve to the first ascending state, and setting the second directional control valve to the second ascending state;

ii) maintaining the position of the boom via setting the first directional control valve to the first neutral state, and setting the second directional control valve to the second neutral state;

iii) moving the boom in the descending direction via setting the first directional control valve to the descending state, and setting the second directional control valve to the second neutral state; and/or iv) permitting the boom to move freely via setting the second directional control valve to the float state, and setting the first directional control valve to the first neutral state; and wherein step iii) further comprises:

a) actuating a float selection input of the working vehicle;

b) detecting a state of the boom actuator;

c) permitting the second directional control valve to transition to the float state if one or more entry conditions are satisfied by the state of the boom actuator;

d) providing an alert to the working vehicle and/or inhibiting the second directional control valve from transitioning to the float state if the float selection input is actuated and one or more entry conditions are not satisfied; optionally, wherein step b) comprises detecting a pressure differential between the ascending chamber and descending chamber, and wherein step c) comprises permitting the second directional control valve to transition to the float state if the pressure differential between the ascending chamber and descending chamber is less than a threshold value.

19. A hydraulic system for a working machine of the kind having a chassis and a boom pivotally attached to the chassis, the hydraulic system comprising:

a hydraulic fluid reservoir;

a boom actuator configured to move the boom in an ascending direction and a descending direction, the boom actuator having an ascending chamber and a descending chamber;

a first pump;

a first directional control valve comprising a first ascending state configured to direct hydraulic fluid from the first pump to the ascending chamber to move the boom in the ascending direction, a descending state configured to direct hydraulic fluid from the first pump to the descending chamber to move the boom actuator in the descending direction, and a first neutral state where the first pump is isolated from the ascending chamber and the descending chamber;

a second pump;

a second directional control valve comprising a second ascending state configured to direct hydraulic fluid from the second pump to the ascending chamber to move the boom actuator in the ascending direction, and a second neutral state where the second pump is isolated from the ascending chamber and the descending chamber; and wherein the second directional control valve further comprises a float state configured to connect at least one of the ascending and descending chambers to the hydraulic reservoir for permitting the boom to move freely in the ascending and/or descending directions;

the hydraulic system further comprising a control system configured to change the state of the first and second directional control valves;

wherein the control system is configured to permit the second directional control valve to transition to the float state when a float selection input of a working vehicle is actuated; and wherein the control system is configured to detect a state of the boom actuator and to permit the second directional control valve to transition to the float state if one or more entry conditions are satisfied.

* * * * *